US005970741A

United States Patent [19]

Tosha et al.

[11] Patent Number: 5,970,741

[45] Date of Patent: Oct. 26, 1999

[54] REFRIGERANT SEPARATOR AND AIR CONDITIONER MOUNTING THE REFRIGERANT SEPARATOR

[75] Inventors: Teruo Tosha; Taii Tsuji, both of Shiga, Japan

[73] Assignee: Matsushita Electric Industrial Co., Ltd., Osaka, Japan

[21] Appl. No.: 08/971,921

[22] Filed: Nov. 18, 1997

[30] Foreign Application Priority Data

Nov. 19, 1996 [JP] Japan ..... 8-307678

[51] Int. Cl.[6] ..... F25B 39/02

[52] U.S. Cl. ..... 62/525; 62/504

[58] Field of Search ..... 62/525, 504

[56] References Cited

U.S. PATENT DOCUMENTS 3,563,055 2/1971 Owens ..... 62/525
3,745,787 7/1973 Ponziani ..... 62/504
4,430,868 2/1984 Kern et al. ..... 62/515
5,743,111 4/1998 Sasaki et al. ..... 62/511

*Primary Examiner*—Henry Bennett
*Assistant Examiner*—Mark Shulman
*Attorney, Agent, or Firm*—McDermott, Will & Emery

[57] ABSTRACT

A refrigerant separator is capable of exhibiting the heat exchanger capacity to the maximum extent, by dividing the refrigerant, including liquid phase and gas phase, at an optimum refrigerant separation ratio, regardless of the mounting position of the refrigerant separator in the heat ex-changer inside the indoor unit of an air conditioner. A first passage having a first opening end, a second passage branched off from the first passage, and a third passage branched off from the first passage are provided. The second passage and third passage are formed in mutually different inside diameters by using an L-shaped partition. Supposing the inside diameter of the second passage to be $\phi A$ and the inside diameter of the third passage to be $\phi B$, $\phi A$ and $\phi B$ are set so as to satisfy the relation of $7/10<\phi B/\phi A)<1$. The refrigerant, including liquid phase and gas phase, enters from the first opening end, passes through the first passage, and is divided and flows into the second passage and third passage.

17 Claims, 8 Drawing Sheets

REFRIGERANT SEPARATOR AND AIR CONDITIONER MOUNTING THE REFRIGERANT SEPARATOR

TECHNICAL FIELD

The present invention relates to a refrigerant separator for dividing a fluid, and an air conditioner mounting this refrigerant separator.

BACKGROUND OF THE INVENTION

A conventional refrigerant separator and an air conditioner mounting this refrigerant separator are described by referring to the drawings.

FIG. 10 shows a heat exchanger provided in an indoor unit of a conventional air conditioner, and a refrigerant separator attached to this heat exchanger, and FIG. 11 is a partially magnified view of FIG. 10 showing the refrigerant separator. In FIG. 10, inside the indoor unit, a front heat exchanger 1001*a* and a rear heat exchanger 1001*b* are provided, and a refrigerant separator 1002 is installed between the front heat exchanger 1001*a* and rear heat exchanger 1001*b*. The refrigerant, including a gas phase and a liquid phase, flows in from the direction of arrow A in cooling operation, and is divided into the direction of arrow B and the direction of arrow C by the refrigerant separator 1002. In FIG. 11, the conventional refrigerant separator main body 11 comprises a first separation opening end 1101, a second separation opening end 1102, a partition 1103 for forming a fluid passage, and a refrigerant separation board 1104 for dividing the refrigerant entering from the first separation opening end into a second passage 1108 and a third passage 1109. The inside diameter $\phi I$ of the divided second passage 1108 and the inside diameter $\phi H$ of the third passage 1109 are the same. Flowing in from the direction A, the refrigerant fluid passes through the first passage 1107, and is divided into the second passage 1108 and third passage 1109, and flows in the direction B and direction C.

In reference to the conventional design, however, when the refrigerant fluid flows in from the first separation opening end 1101 (direction A), due to the angle of the mounting position of the refrigerant separator to the heat exchanger in the indoor unit, the fluid cannot be divided into the direction B and direction C at an optimum refrigerant separation ratio. That is, the front heat exchanger 1001*a* and rear heat exchanger 1001*b* are mutually positioned at a specified angle. Therefore, when the refrigerant separator 1002 is mounted to these heat exchangers 1001*a*, 1001*b*, and in an oblique direction, the refrigerant, including gas phase and liquid phase flowing in from the direction A in a cooling operation, is divided into the direction B and direction C. The refrigerant containing more liquid component flows in the direction C, and the refrigerant containing more gas component flows in the direction B. Hence, the fluid is not divided at an optimum refrigerant separation ratio. Accordingly, the heat exchange capability of the front heat exchanger 1001*a* and rear heat exchanger 1001*b* cannot be sufficiently exhibited, and the instability of the refrigerant separation ratio impairs the bath temperature distribution in humid conditions, possibly causing water splashes due to dew condensation, as well as condensation of dew on the fan. Moreover, since the refrigerant containing relatively higher concentration of liquid component flows in the direction C, refrigerant noise occurs (that is, the refrigerant boiling sound) during the cooling operation.

Hence, it is an object of the present invention to solve the problems of the prior art, and present a refrigerant separator capable of dividing the fluid at an optimum refrigerant separation ratio, and an air conditioner mounting such a refrigerant separator.

SUMMARY OF THE INVENTION

A refrigerant separator of the invention comprises a first passage having a first opening end, a second passage branched from the first passage, and a third passage branched from the first passage. The second passage and the third passage have mutually different sectional areas, and a refrigerant including gas and liquid, enters from the first opening end, passes through the first passage, and is divided and flows into the second passage and third passage.

Preferably, the second passage and the third passage are integrally formed, where a partition is installed between the second passage and the third passage, and the second passage and the third passages are mutually separated by the partition.

Preferably, the inlet of the second passage has a narrower sectional area than the outlet.

Preferably, the inlet of the third passage has a narrower sectional area than the outlet.

Preferably, an L-shaped partition is installed between the second passage and the third passage, the third passage is formed at a projection side of the L-shaped partition, and the third passage has a narrower sectional area than the second passage owing to the projection.

Preferably, the second passage has a nearly circular section, the third passage has a nearly circular section, and the inside diameter $\phi A$ of the second passage and the inside diameter $\phi B$ of the third passage have the relation $7/10<(\phi B/\phi A)<1$.

Preferably, the refrigerant separator further includes a third piping connected to the third passage, wherein the third piping has a U-form folded shape, and the flowing direction of the refrigerant coming out from the third passage is converted.

Preferably, the refrigerant separator further includes a third piping connected to the third passage, wherein the outlet of the third piping has a narrower sectional area than the inlet.

Preferably, the refrigerant separator further includes a second piping connected to the second passage, wherein the outlet of the second piping has a narrower sectional area than the inlet.

Preferably, the refrigerant separator further includes a first piping connected to the first opening end of the first passage, wherein the sectional area of the outlet of the first piping is gradually reduced so as to be narrower than the sectional area of the inlet.

Preferably, the refrigerant separator further includes a first piping connected to the first opening end of the first passage, wherein the intermediate part of the first piping has a narrower sectional area than both its ends.

Preferably, the line linking the second passage and the third passage of the refrigerant separator is positioned vertically to the heat exchanger.

Preferably, the line linking the second passage and the third passage of the refrigerant separator is positioned parallel to the heat exchanger.

The embodiments described above provide a number of significant advantages. For example, the refrigerant, including gas and liquid, entering from the first opening end and passing through the first passage, is divided so as to flow into the second passage and third passage at an appropriate rate.

As yet another advantage, an unstable refrigerant flow including gas and liquid can be straightened at a high reliability.

Furthermore, another advantage is that generation of the flowing sound of the refrigerant flowing in the piping can be suppressed. As a result, an air conditioner exhibiting the cooling capability to the maximum extent in all ranges can be obtained.

The invention itself, together with further objects and attendant advantages, will best be understood by reference to the following detailed description taken in conjunction with the accompanying drawings.

DETAILED DESCRIPTION OF THE INVENTION

Figure 1:
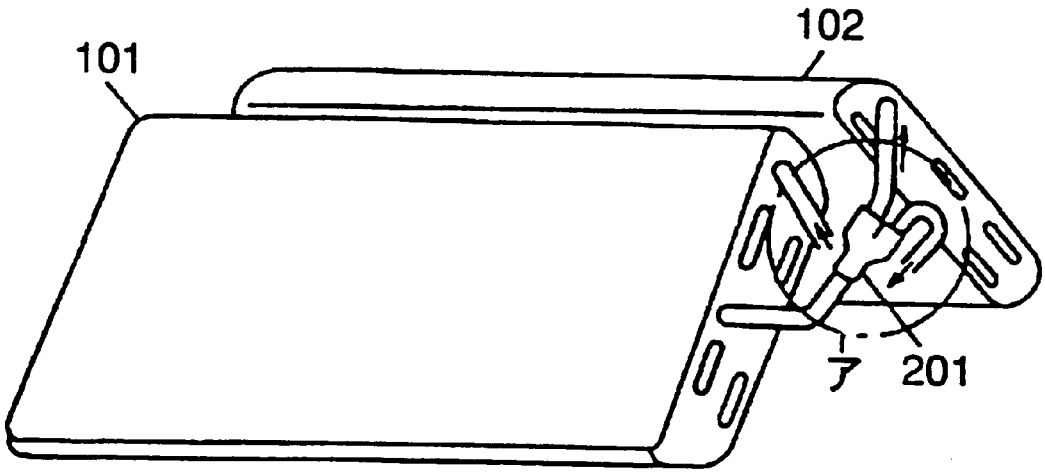
FIG. 1 is a perspective view of a heat exchanger mounting a refrigerant separator in a first embodiment of the invention.

Referring now to the drawings, embodiments of the invention are described below.

Embodiment 1

Figure 2:
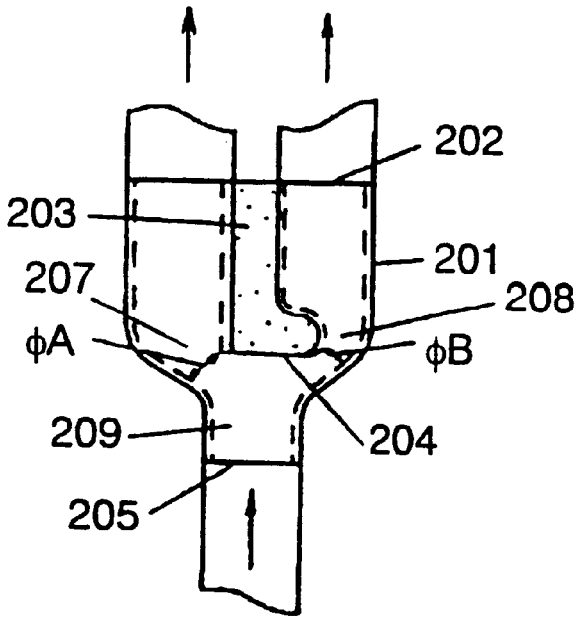
FIG. 2 is a front view of the refrigerant separator in the first embodiment of the invention.

A perspective view of a heat exchanger mounting a refrigerant separator of a first embodiment of the invention is illustrated in FIG. 1. A refrigerant separator 201 of the invention is connected and disposed in the intermediate part between a front heat exchanger 101 and a rear heat exchanger 102. FIG. 2 is a sectional view of the refrigerant separator shown in FIG. 1. The refrigerant separator 201 comprises a first passage 209, a second passage 207, and a third passage 208. The first passage 209, second passage 207, and third passage 208 are formed integrally. At the side of a second separation opening end 202 inside the refrigerant separator 201, a partition 203 is provided to form two fluid passages, second passage 207 and third passage 208. The inlet of the second passage 207 (i.e., the end toward the first separation opening end 205) has a narrower sectional area than the outlet (i.e., the end distal from the first separation opening end 205). The inlet of the third passage 208 (i.e., the end toward the first separation opening end 205) has a narrower sectional area than the outlet (i.e., the end distal from the first separation opening end 205). The inside diameter of the second passage 207 and the inside diameter of the third passage 208 are mutually different. That is, the inside diameter $\phi A$ of the first separation opening end 205 side of the second passage 207 and the inside diameter $\phi B$ of the first separation opening end 205 side of the third passage 208 are mutually different.

In other words, the second passage 207 and third passage 208 have mutually different sectional areas. More preferably, an L-shaped separation board 204 is disposed continuously to the partition 203, and the inside diameters of the narrowest portions of the passages should respectively be $\phi A$ and $\phi B$. In this embodiment, the flow of the refrigerant, including liquid phase and gas phase, enters from the first opening end 205, as indicated by arrow, passes through the first passage 209 where it is divided and then flows into the second passage 207 and third passage 208. The individual refrigerants flowing out from the second passage 207 and third passage 208 flow into the respective heat exchangers.

In this embodiment, the refrigerant, including the gas phase and liquid phase flowing in from the first separation opening end side, is divided into the second passage 207 and third passage 208 at an optimum separation ratio.

Figure 9:
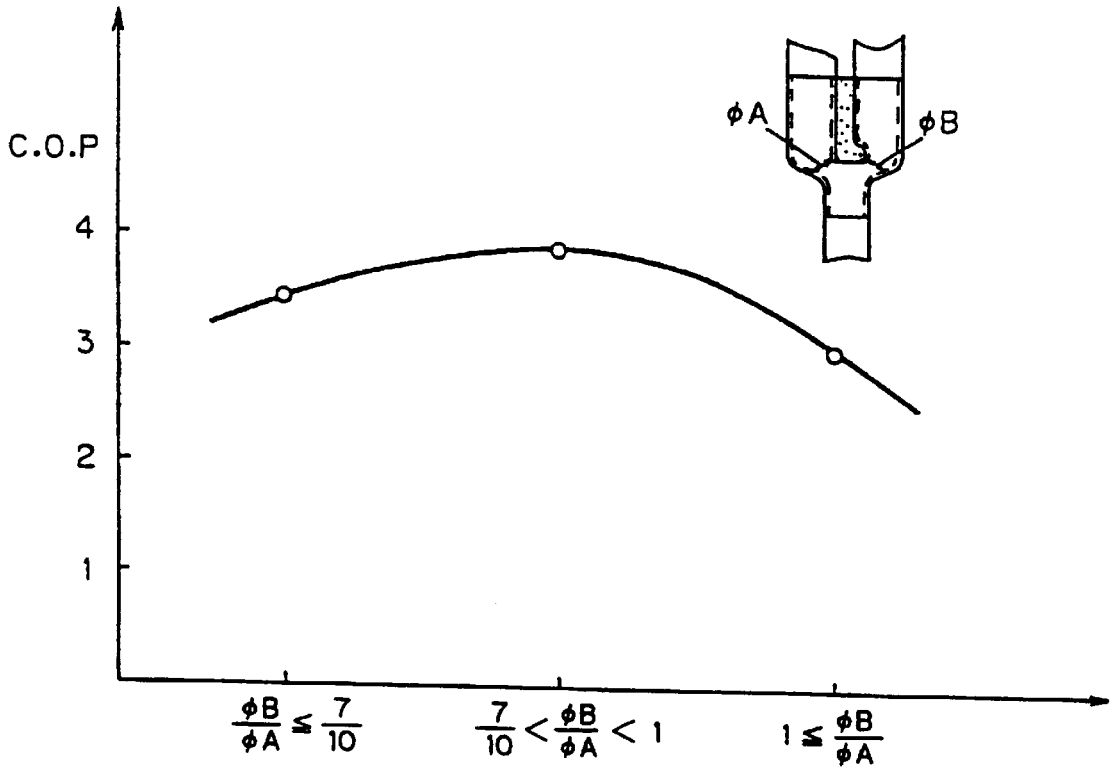
FIG. 9 is a graph illustrating the relation of coefficient of performance (COP) to the inside diameter ratio in the first embodiment of the invention.
Figure 10:
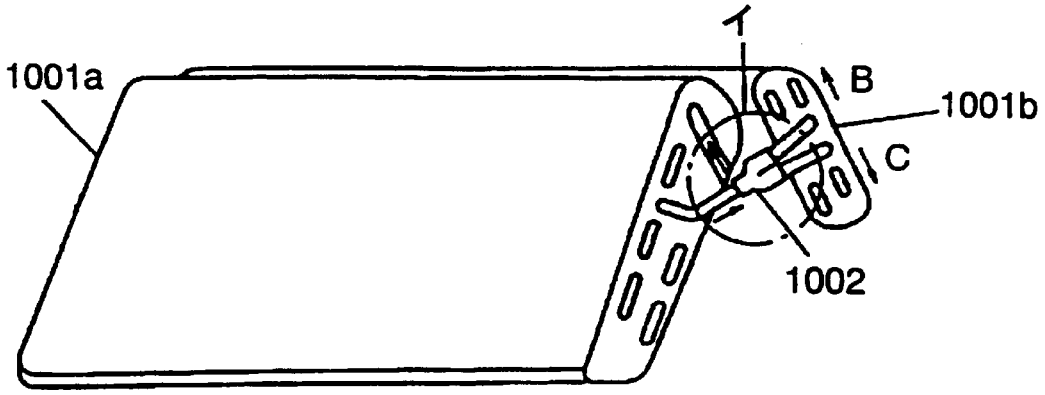
FIG. 10 PRIOR ART
FIG. 10 is a perspective view of a heat exchanger mounting a refrigerant separator in an prior art.
Figure 11:
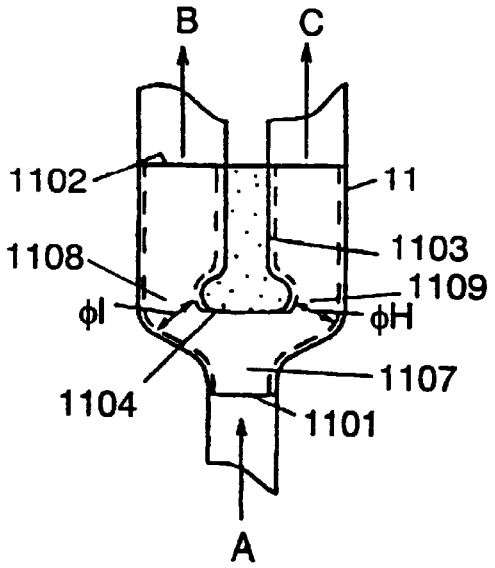
FIG. 11 is a front view of the refrigerant separator in the prior art.

The relation between $\phi B/\phi A$ and the coefficient of performance (COP) is graphically illustrated in FIG. 9. In FIG. 9, the optimum cooling performance is obtained when the value of $\phi B/\phi A$ is in a range of 7/10 to 1. As the value of $\phi B/\phi A$ becomes smaller than 7/10, the cooling performance declines. As the value of $\phi B/\phi A$ becomes larger than 1, the cooling performance also declines. That is, when the inside diameter $\phi A$ of the second passage 207 is greater than the inside diameter $\phi B$ of the third passage 208, it is preferable that the inside diameter ratio be in a range of $7/10<(\phi B/\phi A)<1$ for optimum performance. For example, when the second passage 207 is a passage to the rear heat exchanger 102 and the third passage 208 is a passage to the front heat exchanger 101, the preferred inside diameter ratio is satisfied with the equation $\phi B:\phi A=4.7:5.3$.

In this embodiment, the first passage 209, second passage 207 and third passage 208 are approximately circular-shaped. However, they are not limited to a circular shape, as they may also be formed in elliptical, polygonal or other arbitrary shapes. It is also possible to use an L-shaped partition by integrally forming the partition 203 and the L-shaped separation board 204.

Embodiment 2

Figure 3:
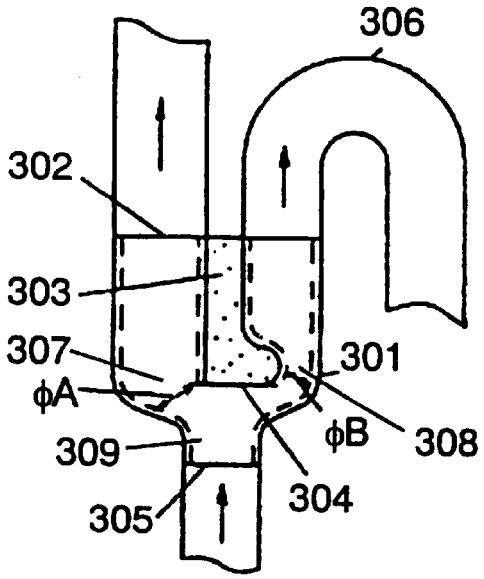
FIG. 3 is a front view of a refrigerant separator in a second embodiment of the invention.

FIG. 3 is a sectional view of a second embodiment of the invention. A refrigerant separator 301 comprises a first passage 309, a second passage 307, and a third passage 308. At the side of a second separation opening end 302 inside the refrigerant separator 301, a partition 303 is provided to form two fluid passages, second passage 307 and third passage 308. The inside diameter of the second passage 307 and the inside diameter of the third passage 308 are mutually different. That is, the inside diameter $\phi A$ of the first separation opening end 305 side of the second passage 307 and the inside diameter $\phi B$ of the first separation opening end 305 side of the third passage 308 are mutually different. In other words, the second passage 307 and third passage 308 have mutually different sectional areas. More preferably, an L-shaped separation board 304 is disposed continuously to the partition 303, and the inside diameters of the narrowest portions of the passages formed by the L-shaped separation board 304 should be $\phi A$ and $\phi B$. In addition, one of the second passage 307 and third passage 308 has a refrigerant piping 306 for converting the flowing direction by 180 degrees. Referring to FIG. 3, the refrigerant piping 306 coupled to the third passage 308 is bent to about 180 degrees. In this arrangement, a refrigerant, including liquid phase and gas phase, enters (as indicated by arrow) from the first opening end 305, passes through the first passage 309, and is divided and flows into the second passage 307 and third passage 308. The refrigerant passing through the third passage 308 is converted in the flowing direction by 180 degrees by the refrigerant piping 306. The individual refrigerants flowing out from the second passage 307 and refrigerant piping 306 flow into the respective heat exchangers.

Where the inside diameter $\phi A$ of the second passage 307 is greater than the inside diameter $\phi B$ of the third passage 308, in order that the inside diameter ratio may be in a range of $7/10<(\phi B/\phi A)<1$, a separation member 304 having an L-shape is disposed integrally with the partition 303, and the refrigerant piping 306 coupled to the third passage 308 is bent.

In this embodiment, the flowing direction of the divided refrigerant flowing in the third passage 308 is diverted by 180 degrees. The divided refrigerant, having a high liquid component, is restricted in flow. As a result, the heat exchanger capacity can be exerted to the maximum extent, not only in the standard capacity of cooling, but also in all ranges, from cooling intermediate to cooling minimum capacity.

Hence, an advantage of the present invention is that the refrigerant can be divided into a separation ratio so that the capacity of the heat exchanger may be exhibited to the maximum extent.

Embodiment 3

Figure 4:
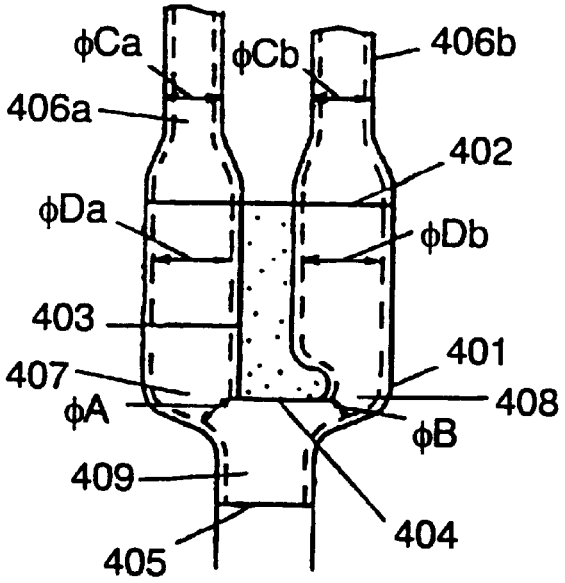
FIG. 4 is a front view of a refrigerant separator in a third embodiment of the invention.

FIG. 4 is a sectional view of a third embodiment of the invention. A refrigerant separator 401 comprises a first passage 409, a second passage 407, and a third passage 408. At the side of a second separation opening end 402 inside the refrigerant separator 401, a partition 403 is provided to form two fluid passages, second passage 407 and third passage 408. The inside diameter of the second passage 407 and the inside diameter of the third passage 408 are mutually different. That is, the inside diameter $\phi A$ of the first separation opening end 405 side of the second passage 407 and the inside diameter $\phi B$ of the first separation opening end 405 side of the third passage 408 are mutually different. In other words, the second passage 407 and third passage 408 have mutually different sectional areas. More preferably, an L-shaped separation board 404 is disposed continuously to the partition 403, and the inside diameters of the narrowest portions formed by the L-shaped separation board 404 are $\phi A$ and $\phi B$. In addition, a third refrigerant piping **406*b* is continuously disposed on the third passage 408, and a second refrigerant piping 406*a* is continuously disposed on the second passage 407. The inside diameter $\phi Cb$ of the downstream side (outlet side) of the third refrigerant piping 406*b* is smaller than the inside diameter $\phi Db$ of the upstream side (inlet side), and the inside diameter $\phi Ca$ of the downstream side (outlet side) of the second refrigerant piping 406*a*** is smaller than the inside diameter $\phi Da$ (inlet side) of the upstream side.

In this embodiment, when the refrigerant flows, a straightening action is applied. When the inside diameter $\phi A$ of the second passage 407 is greater than the inside diameter $\phi B$ of the third passage 408, it is preferable that the inside diameter ratio is in a range of $7/10<(\phi B/\phi A)<1$. Similarly, it is preferable that the inside diameter ratio is in the range $1/2(\phi Ca/\phi Da)<9/10$, and $1/2<(\phi Cb/\phi Db)<9/10$.

As a result, an advantage of the present invention is that unstable refrigerant flow, including gas phase, and liquid phase can be straightened at high reliability.

Embodiment 4

Figure 5:
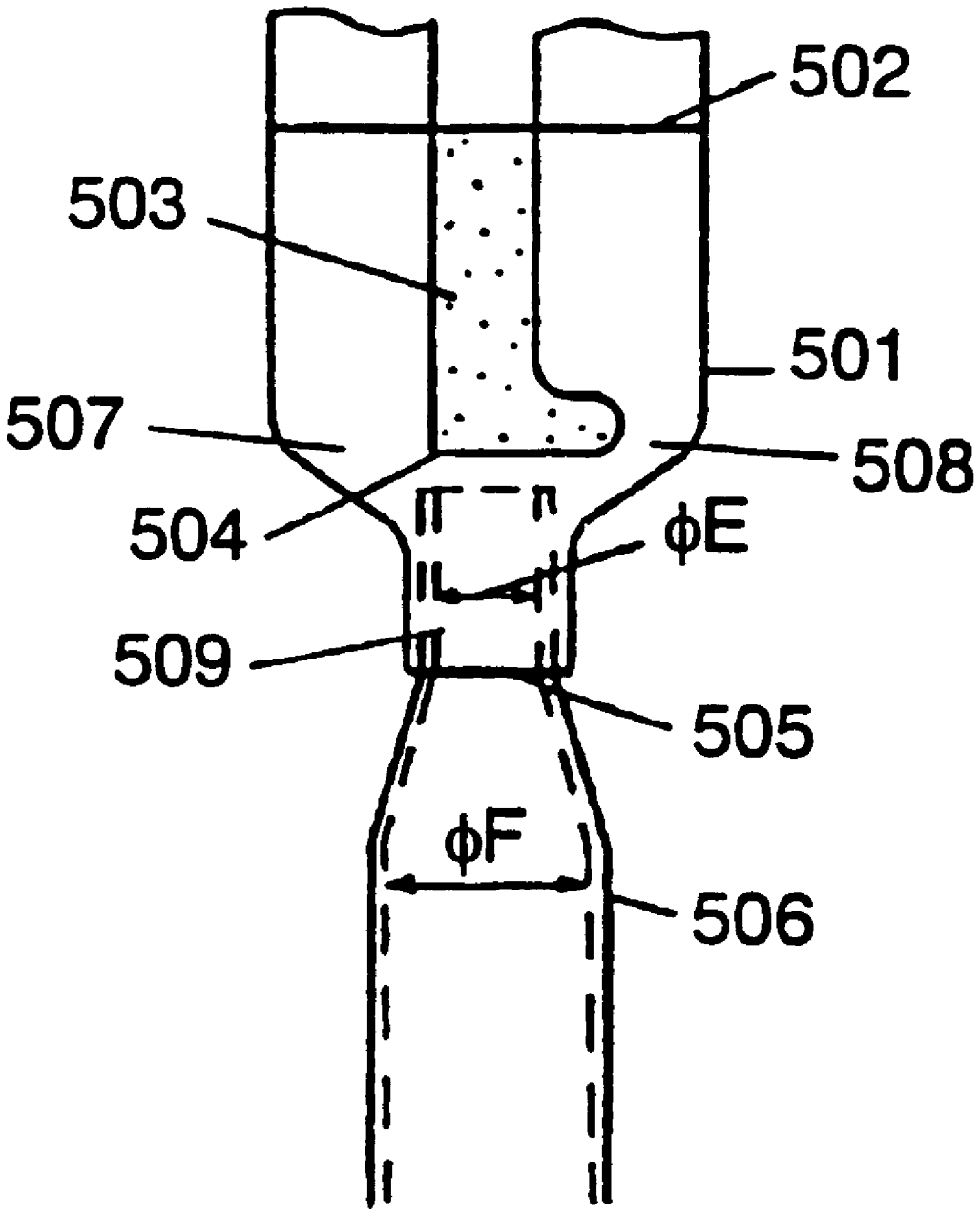
FIG. 5 is a front view of a refrigerant separator in a fourth embodiment of the invention.

FIG. 5 is a sectional view of a fourth embodiment of the invention. A refrigerant separator 501 comprises a first passage 509, a second passage 507, and a third passage 508. At the side of a second separation opening end 502 inside the refrigerant separator 501, a partition 503 is provided to form two fluid passages, second passage 507 and third passage 508. The inside diameter of the second passage 507 and the inside diameter of the third passage 508 are mutually different. An L-shaped separation board 504 is disposed integrally with the partition 503. A refrigerant piping 506 is inserted and disposed in a first separation opening end 505 of the refrigerant separator 501. The refrigerant piping 506 is designed such that its inside diameter $\phi F$ may gradually expand to a diameter that is greater than the inside diameter $\phi E$ of the insertion portion (outlet portion) of the refrigerant piping 506 into the refrigerant separator 501.

As the result, an advantage of the present invention is that the refrigerant flow, including gas phase and liquid phase, is straightened and it is effective for suppressing the generation of refrigerant noise in the refrigerant separator 501 and in the flow from the refrigerant separator 501 to the heat exchanger.

Embodiment 5

Figure 6:
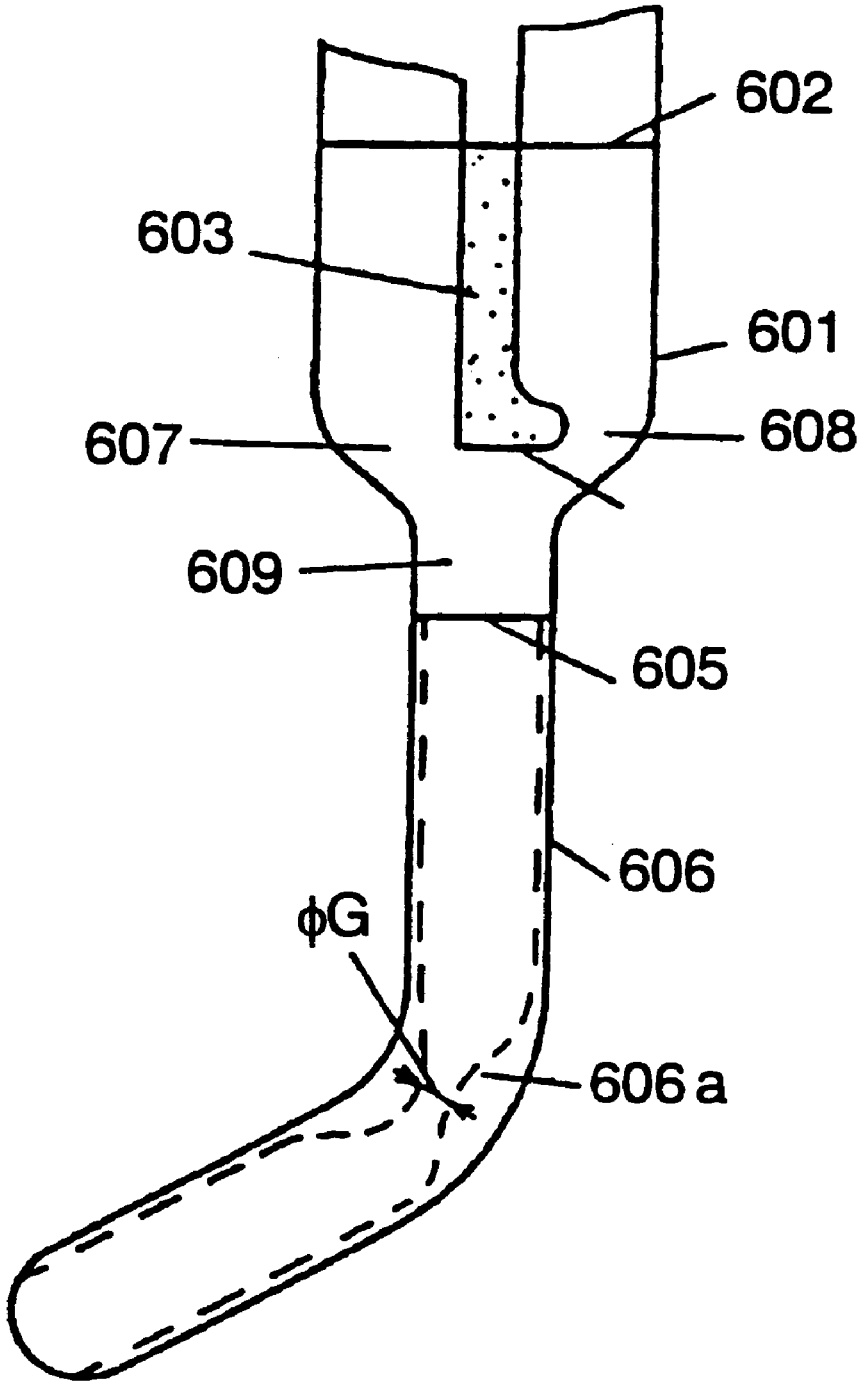
FIG. 6 is a front view of a refrigerant separator in a fifth embodiment of the invention.

FIG. 6 is a sectional view of a fifth embodiment of the invention. A refrigerant separator 601 comprises a first passage 609, a second passage 607, and a third passage 608. At the side of a second separation opening end 602 inside the refrigerant separator 601, a partition 603 is provided to form two fluid passages, second passage 607 and third passage 608. The inside diameter of the second passage 607 and the inside diameter of the third passage 608 are mutually different. An L-shaped separation board 604 is disposed integrally with the partition 603. A refrigerant piping 606 is disposed continuously to the side of a first separation opening end 605 of the refrigerant separator 601. The refrigerant piping 606 has a curvature portion **606*a*, and this curvature portion 606*a*** has an inside diameter $\phi G$ of a reduced shape.

As a result, an advantage associated with this embodiment, is that it is effective for absorbing the shock of the refrigerant flow, including an unstable gas phase and liquid phase, and for controlling the refrigerant vibration located in the refrigerant separator 601, and that which has been transmitted from the refrigerant separator 601 to the heat exchanger.

Embodiment 6

Figure 7A:
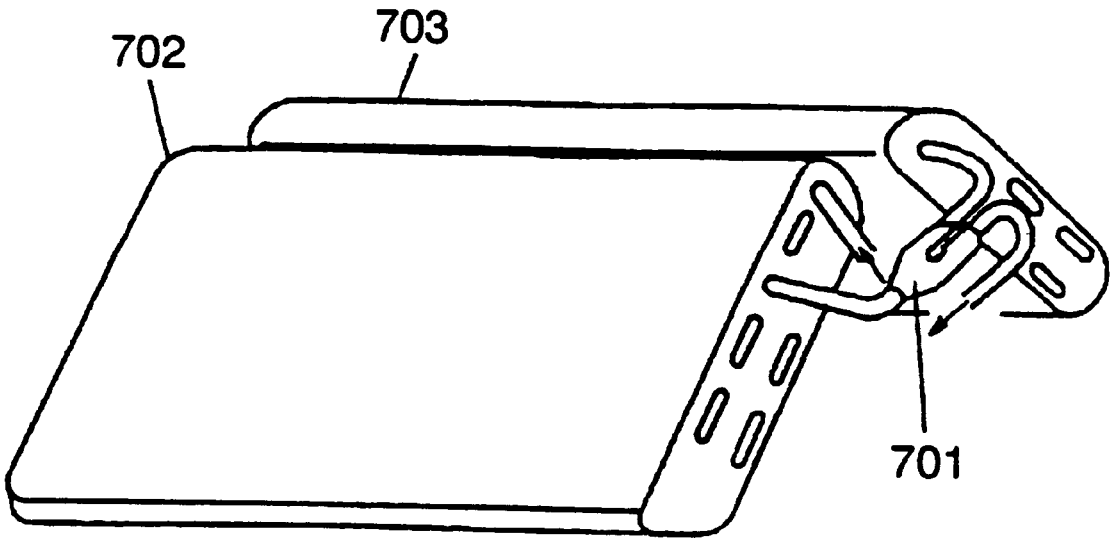
FIG. 7 (*a*) is a perspective view of a heat exchanger in an indoor unit in an embodiment of the invention, and FIG. 7 (*b*) is an essential block diagram of the heat exchanger shown in FIG. 7 (*a*).
Figure 7B:
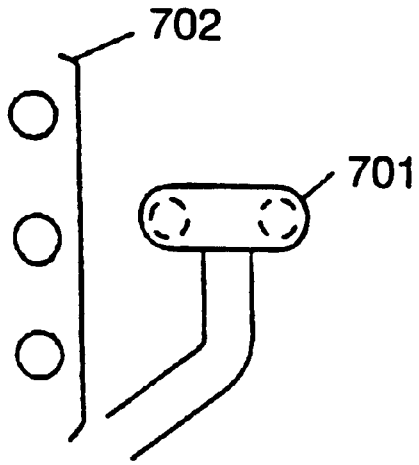

FIG. 7 (*a*) illustrates a perspective view of a sixth embodiment of the invention, and FIG. 7 (*b*) is its associated block diagram. In an indoor unit, a front heat exchanger 702 and a rear heat exchanger 703 are disposed at a specified angle, and a refrigerant separator 701, according to any one of aforementioned embodiments (1 through 5), is provided vertically to the front heat exchanger 702 and rear heat exchanger 703.

As a result, an advantage of this embodiment is that the refrigerant flow, containing a high liquid component, flows into the rear heat exchanger 703, and, therefore, the bath temperature distribution is improved in humid conditions, and the prevention of water splashes and dew condensation is enhanced.

Embodiment 7

Figure 8A:
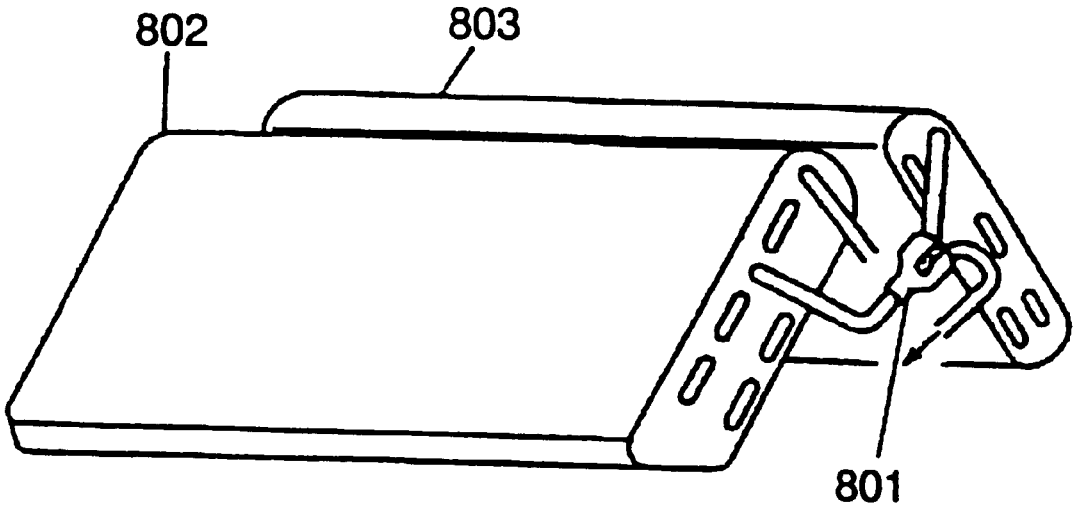
FIG. 8 (*a*) is a perspective view of a heat exchanger in an indoor unit in an embodiment-of the invention, and FIG. 8 (*b*) is an essential block diagram of the heat exchanger shown in FIG. 8 (*a*).
Figure 8B:
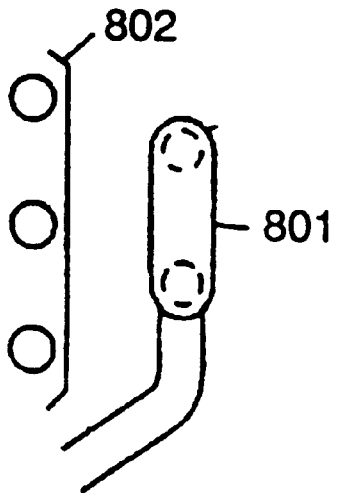

FIG. 8 (*a*) is a perspective view of a seventh embodiment of the invention, and FIG. 8 (*b*) illustrates its associated block diagram. In an indoor unit, a front heat exchanger 802 and a rear heat exchanger 803 are disposed at a specified angle, and a refrigerant separator 801 according to any one of the aforementioned embodiments (1 through 5), is provided vertically to the front heat exchanger 802 and rear heat exchanger 803.

As a result, an advantage associated with this embodiment is that the refrigerant flow, containing a high gas component, flows into the rear heat exchanger, and, therefore, the pressure of the indoor heat exchanger is alleviated in the overload condition, and further elevation of the pressure of the condenser in the refrigeration cycle can be prevented.

Of course, it should be understood that a wide range of changes and modifications can be made to the preferred embodiment described above. It is therefore intended that the foregoing detailed description be understood that it is the following claims, including all equivalents, which are intended to define the scope of this invention.

We claim:

1. A refrigerant separator comprising:

a first passage having a first opening end, a second passage branched from said first passage having an inlet and an outlet at opposite ends, and a third passage branched from said first passage having an inlet and an outlet at opposite ends, said second passage and said third passage having mutually different sectional areas, wherein said first passage is disposed to receive a refrigerant, including gas and liquid which enters from said first opening end, passes through said first passage, and being divided to flow into said second passage and third passage, thereby defining an optimum refrigerant separation.

2. A refrigerant separator of claim 1, wherein said first passage, said second passage, and said third passage are integrally formed, a partition is installed between said second passage and said third passage, and said second passage and said third passages are mutually separated by said partition.

3. A refrigerant separator of claim 1, wherein the inlet of said second passage has a narrower sectional area than the outlet of said second passage.

4. A refrigerant separator of claim 1, wherein the inlet of said third passage has a narrower sectional area than the outlet of said third passage.

5. A refrigerant separator of claim 1, wherein said first passage, said second passage, and said third passage are integrally formed, an L-shaped partition is installed between said second passage and said third passage, said third passage is formed at a projection side of said L-shaped partition, and said third passage has a narrower sectional area than said second passage at said projection.

6. A refrigerant separator of claim 1, wherein said second passage has essentially a circular-shaped section, said third passage has essentially a circular-shaped section, and the inside diameter $\phi A$ of said second passage and the inside diameter $\phi B$ of said third passage are in the relation of $$7/10<(\phi B/\phi A)<1.$$

7. A refrigerant separator of claim 1, further comprising a third piping connected to said third passage, wherein said third piping has a U-form folded shape, and the flowing direction of said refrigerant coming out from said third passage is converted to the U-form folded shape.

8. A refrigerant separator of claim 1, further comprising a third piping having an inlet and an outlet at opposite ends, wherein said third piping is connected to said third passage, wherein the outlet of said third piping has a narrower sectional area than the inlet of said third piping.

9. A refrigerant separator of claim 1, further comprising a second piping having an inlet and an outlet at opposite ends, wherein said second piping is connected to said second passage, wherein the outlet of said second piping has a narrower sectional area than the inlet of said second piping.

10. A refrigerant separator of claim 1, further comprising a first piping having an inlet and outlet at opposite ends, wherein the first piping is connected to said first opening end of said first passage, wherein the sectional area of the outlet of said first piping is gradually narrowed until it is less than the sectional area of the inlet of said first piping.

11. A refrigerant separator of claim 1, further comprising a first piping connected to said first opening end of said first passage, wherein the intermediate part of said first piping has a narrower sectional area than both of its ends.

12. A refrigerant separator of claim 1, further comprising a first piping connected to said first opening end of said first passage, wherein the intermediate part of said first piping has a narrower sectional area than both of its ends, and has a bent shape.

13. An air conditioner comprising a refrigerant separator of claim 1, and a heat exchanger, wherein the line linking said second passage and said third passage of said refrigerant separator is positioned vertically to said heat exchanger.

14. An air conditioner comprising a refrigerant separator of claim 1, and a heat exchanger, wherein the line linking said second passage and said third passage of said refrigerant separator is positioned parallel to said heat exchanger.

15. A refrigerant separator comprising:

a first passage having a first opening end, a second passage branched from said first passage, a third passage branched from said first passage, and an L-shaped partition disposed between said second passage and said third passage, wherein said third passage is formed at a projection side of said L-shaped partition, said third passage has a narrower sectional area than said second passage at said projection, the inside diameter $\phi A$ of said second passage and the inside diameter $\phi B$ of said third passage are in the relation of $$7/10<(\phi B/\phi A)<1,$$

and a refrigerant including gas and liquid enters from said first opening end, passes through said first passage, and is divided and flows into said second passage and third passage.

16. A refrigerant separator comprising:

a first passage having a first opening end, a second passage branched from said first passage, a third passage branched from said first passage, an L-shaped partition disposed between said second passage and said third passage, and a first piping having an inlet and an outlet at opposite ends, wherein said first piping is connected to said first opening end of said first passage, wherein said third passage is formed at a projection side of said L-shaped partition, said third passage has a narrower sectional area than said second passage at said projection, the inside diameter $\phi A$ of said second passage and the inside diameter $\phi B$ of said third passage are in the relation of $$7/10<(\phi B/\phi A)<1,$$

the sectional area of the outlet of said first piping is gradually narrowed until it is less than the sectional area of the inlet of said first piping, and a refrigerant including gas and liquid enters from said first opening end, passes through said first passage, and is divided and flows into said second passage and third passage.

17. A refrigerant separator of claim 1, further comprising a refrigerant disposed in said first passage, second passage and third passage.

* * * * *